United States Patent [19]

Harandi

[11] Patent Number: 4,714,524

[45] Date of Patent: Dec. 22, 1987

[54] APPARATUS FOR MINIMIZING RECYCLING IN AN UNSATURATED GAS PLANT

[75] Inventor: Mohsen N. Harandi, Lawrenceville, N.J.

[73] Assignee: Mobil Oil Corporation, New York, N.Y.

[21] Appl. No.: 853,517

[22] Filed: Apr. 18, 1986

Related U.S. Application Data

[62] Division of Ser. No. 688,084, Dec. 31, 1984, Pat. No. 4,605,493.

[51] Int. Cl.[4] ..... C10G 7/02

[52] U.S. Cl. ..... 196/98

[58] Field of Search ..... 208/340–343, 208/346; 196/98; 202/176; 55/48

[56] References Cited

U.S. PATENT DOCUMENTS

| | | | |
|---|---|---|---|
| 2,284,592 | 5/1942 | Rupp et al. | 208/341 |
| 2,322,354 | 6/1943 | Gerhold et al. | 208/341 |
| 2,324,112 | 7/1943 | Rupp et al. | 208/341 |
| 2,630,403 | 3/1953 | Miller | 208/346 |
| 2,719,816 | 10/1955 | Rich | 208/342 |
| 3,574,089 | 4/1971 | Forbes | 208/342 |
| 4,431,529 | 2/1984 | Carson | 208/343 |

FOREIGN PATENT DOCUMENTS 909705 9/1972 Canada .

*Primary Examiner*—Michael S. Marcus
*Assistant Examiner*—Joye L. Woodard
*Attorney, Agent, or Firm*—Alexander J. McKillop; Michael G. Gilman; Dennis P. Santini

[57] ABSTRACT

An unsaturated gas plant system includes a first unit which receives a low pressure hydrocarbon gas input provides a liquid output and a gaseous output, an absorber which receives an unstabilized gasoline input and a lean oil input, a stripper, and a low temperature separator which provides an overhead products output to the absorber and a bottoms product output to the stripper. A high temperature separator is provided for receiving an input which includes the liquid output and the gaseous output from the first unit, bottoms product from the absorber and overhead product from the stripper and which provides a hot liquid hydrocarbon output to an upper section of the stripper and a gaseous output to the low temperature separator after passing through a condenser. A portion of the unstabilized gasoline input to the absorber is diverted to the high temperature separator input. The diverted unstabilized gasoline can be taken directly from a main column fluid catalytic conversion system fractionator.

4 Claims, 3 Drawing Figures

APPARATUS FOR MINIMIZING RECYCLING IN AN UNSATURATED GAS PLANT

CROSS REFERENCE TO RELATED APPLICATION

This is a Division of application Ser. No. 688,084 filed Dec. 31, 1984, now U.S. Pat. No. 4,605,493.

BACKGROUND OF THE INVENTION

1. Field of the Invention

The present invention relates to unsaturated gas plants for either fluid catalytic conversion or thermofor catalytic conversion systems.

2. Background of the Invention

In conventional unsaturated gas plants, the compressor aftercooler acts in a similar manner to a partial condenser to the stripper. This causes excessive recycle between the low temperature separator and the stripper. Also, because all unstabilized gasoline enters the absorber, excessive light ends recycling occurs between the low temperature separator and the absorber.

The conventional unsaturated gas plant, shown in FIG. 1, shows low pressure gas from, e.g., a fluid catalytic conversion (FCC) main column overhead accumulator being fed to a first stage compressor 1, while unstabilized gasoline from the main column overhead accumulator is fed to primary absorber 3. The gaseous output from first stage compressor 1, which was heated in compressor 1, is fed to interstage cooler 5 which cools this gaseous output so that the gas going to second stage compressor 9 will be at a lower temperature to provide increased energy efficiency. The mixed output of interstage cooler 5 comprises a mixed-phase liquid and gaseous portion which is sent to interstage receiver/separator 7 which provides a gaseous output to second stage compressor 9 and a liquid output along line 11. Line 11 also contains water wash to the unsaturated gas plant. Gaseous product discharged from second stage compressor 9 is combined with bottoms product from primary absorber 3, stripper overhead from stripper 13 and liquid output from interstage receiver/separator 7 to form a mixed product in line 25 which is fed to aftercooler 17. The output of aftercooler 17 is fed to low temperature-high pressure separator 15 where it is flashed and water is separated from the hydrocarbons. Liquid hydrocarbon bottoms product from separator 15 is fed to stripper 13 and vapor from high pressure-low temperature separator 15 is fed to primary absorber 3. Bottoms product from stripper 13 is passed to a debutanizer, while stripper 13 overhead product is sent along line 19 to mix with lines 11, 21 and 23 prior to being fed to aftercooler 17, as noted above.

The FIG. 1 prior art system is not energy-efficient due to mixing of the hot gas outputs from second stage compressor 9 and stripper 13 and the relatively cool liquid outputs from interstage receiver/separator 7 and primary absorber 3 bottoms product. After mixing, these gaseous and liquid outputs are sent through aftercooler 17 prior to being fed to three-phase low temperature-high pressure separator 15. Input line 29 into separator 15 carries a mixed stream at relatively low temperature. Because of this relatively low temperature, the heavy ends in line 29 absorb a relatively large amount of light ends. Thus, the bottoms product of low temperature-high pressure separator 15 contains a relatively large amount of light ends, requiring stripper 13 and its reboiler 31 to be oversized and to recycle light ends between stripper 13 and low temperature-high pressure separator 15 continuously via stripper overhead line 19.

SUMMARY OF THE INVENTION

It is an object of the present invention to provide a new and improved unsaturated gas plant system, in which the above described inefficiencies in the prior art systems are overcome.

It is also an object of the present invention to minimize recycling in unsaturated gas plants.

According to the present invention, an unsaturated gas plant is provided which comprises (a) first means for receiving a low pressure gas input and for providing a liquid output and a gaseous output, (b) an absorber receiving an unstabilized gasoline input and a lean oil, e.g., de-butanized gasoline input, (c) a stripper, (d) a low temperature separator for providing an overhead product output to the absorber and a bottoms product output to the stripper, and (e) a high temperature separator for receiving a high temperature separator input comprising the liquid output and the gaseous output from the first means, bottoms product from the absorber and overhead product from the stripper and for providing a liquid hydrocarbon output to the stripper and a gaseous output to the low temperature separator after passing through a condenser. The system can further include means for diverting a portion of the unstabilized gasoline input to the high temperature separator input. The means for diverting can divert the aforesaid portion of the unstabilized gasoline input to mix it with the other high temperature separator input prior to being introduced into the high temperature separator.

The first means can comprise a first stage compressor for receiving the low pressure gas input, an interstage cooler interconnecting the first stage compressor with an interstage receiver/separator for separating an output of the interstage cooler into liquid and gaseous output portions, and a second stage compressor for receiving the gaseous output portion from the interstage receiver/separator and for providing a gaseous output, with the liquid output from the first means comprising the liquid output portion from the interstage cooler and the gaseous output from the first means comprising the gaseous output from the second stage compressor. This unsaturated gas plant system further comprises an aftercooler for receiving and cooling the gaseous output from the high temperature separator and for providing a cooled mixed-phase output to the low temperature separator.

Also according to the present invention, in an unsaturated gas plant which includes first means receiving a low pressure gas input for providing a liquid output and a gaseous output, an absorber receiving an unstabilized gasoline input and a hydrocarbon oil input, a stripper and a low temperature separator for providing an overhead output to the absorber and a bottoms product output to the stripper, an improved method of operation is provided. This method comprises the steps of (a) mixing the liquid output from the first means, the gaseous output from the first means, bottoms product from the absorber and overhead product from the stripper, (b) separating the mixture provided in step (a) into a liquid hydrocarbon portion and a gaseous portion, (c) introducing the liquid hydrocarbon portion into the stripper, and (d) introducing the gaseous portion into the low temperature separator after passing through a condenser. This method can further include diverting a portion of the unstabilized gasoline input and mixing the diverted portion with the mixture provided in step (a) prior to being separated in step (b). The diverted portion can be mixed with the absorber bottoms product prior to being mixed in step (a). Alternatively, unstabilized gasoline can be diverted directly from a main column fractionator and the diverted unstabilized gasoline can be mixed with the mixture provided in step (a) prior to being separated in step (b). Step (b) can include separating the mixture provided in step (a) in a high temperature separator.

Also according to the present invention, in an unsaturated gas plant system comprising a first stage compressor for receiving a low pressure gas input, an interstage cooler interconnecting the first stage compressor with an interstage receiver/separator for separating an output of the interstage cooler into liquid and gaseous output portions and a second stage compressor for receiving the gaseous output portion from the interstage receiver/separator and for providing a gaseous output, an absorber receiving an unstabilized gasoline input and a hydrocarbon oil input, a stripper, and a low temperature separator for providing an overhead output to the absorber and a bottoms product output to the stripper, an improved method of operation is provided. Such method comprises the steps of (a) mixing the liquid output from the interstage receiver/separator, the gaseous output from the second stage compressor, bottoms product from the absorber and overhead product from the stripper, (b) separating the mixture provided in step (a) into a liquid hydrocarbon portion and a gaseous portion, (c) introducing the liquid hydrocarbon portion into the stripper and (d) introducing the gaseous portion into the low temperature separator after passing through a condenser. The method can further include diverting a portion of the unstabilized gasoline input and mixing the diverted portion with the mixture provided in step (a) prior to being separated in step (b). The diverted portion can be mixed with the absorber bottoms product prior to being mixed in step (a). Alternatively, the unstabilized gasoline can be diverted directly from a main column fractionator and the diverted unstabilized gasoline can be mixed with the mixture provided in step (a) prior to being separated in step (b). Step (b) can include separating the mixture provided in step (a) in a high temperature separator.

BRIEF DESCRIPTION OF THE DRAWINGS

The above and other objects, advantages and features of the present invention will be more fully understood when considered in conjunction with the following figures, of which.

DETAILED DESCRIPTION OF THE INVENTION

Figure 1:
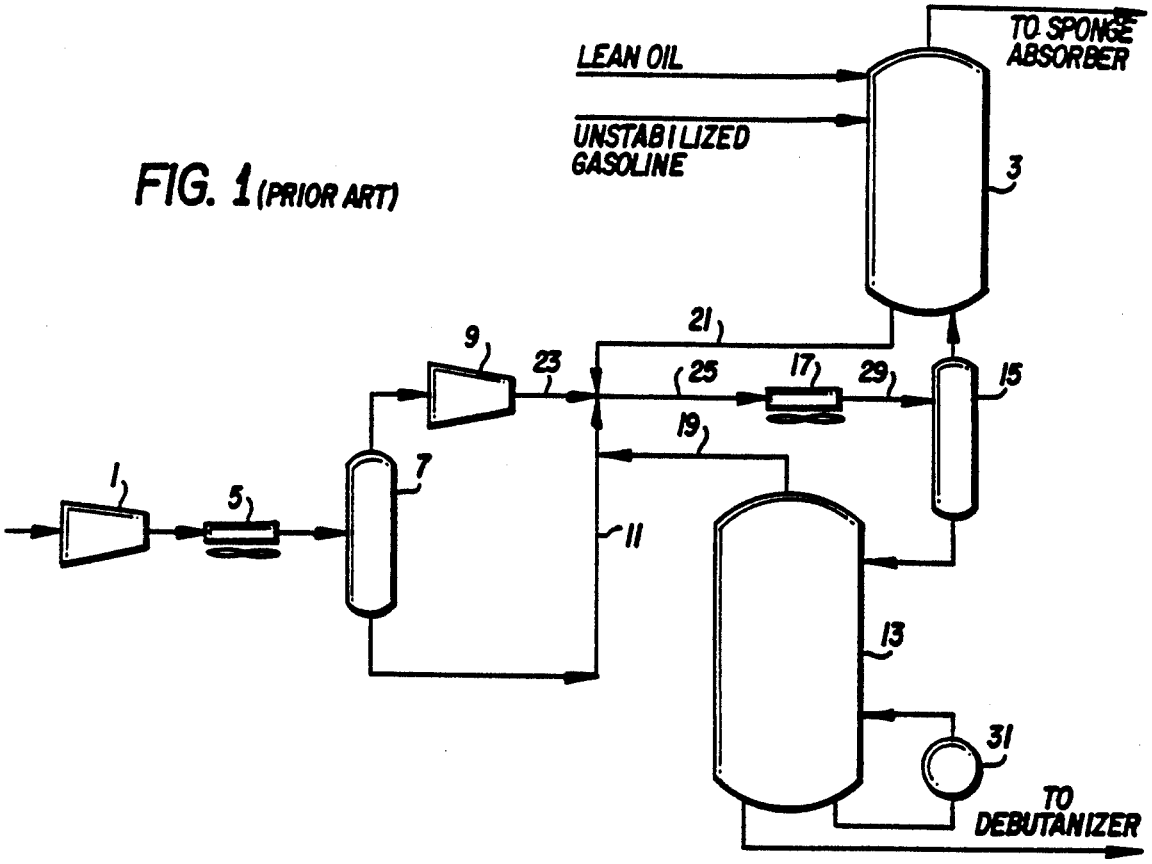
FIG. 1 (PRIOR ART)
FIG. 1 illustrates a conventional unsaturated gas plant.
Figure 2:
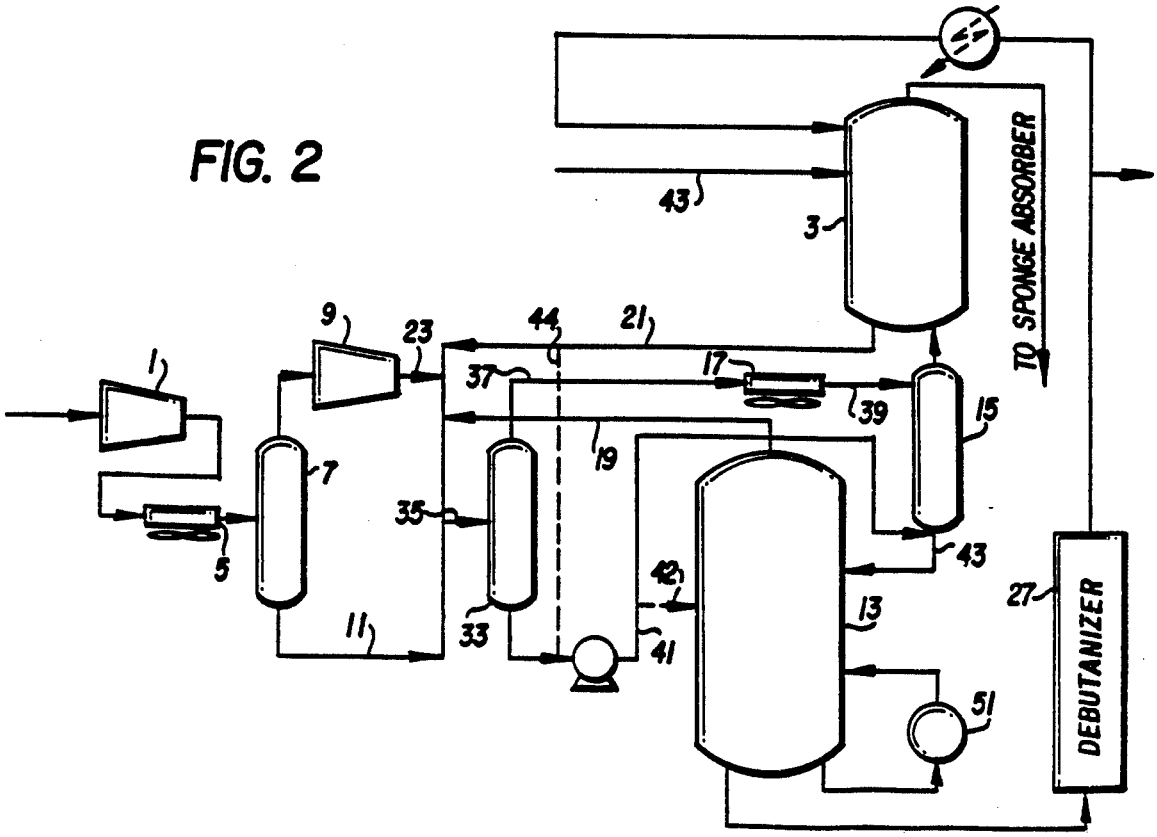
FIG. 2 illustrates an unsaturated gas plant according to the present invention.
Figure 3:
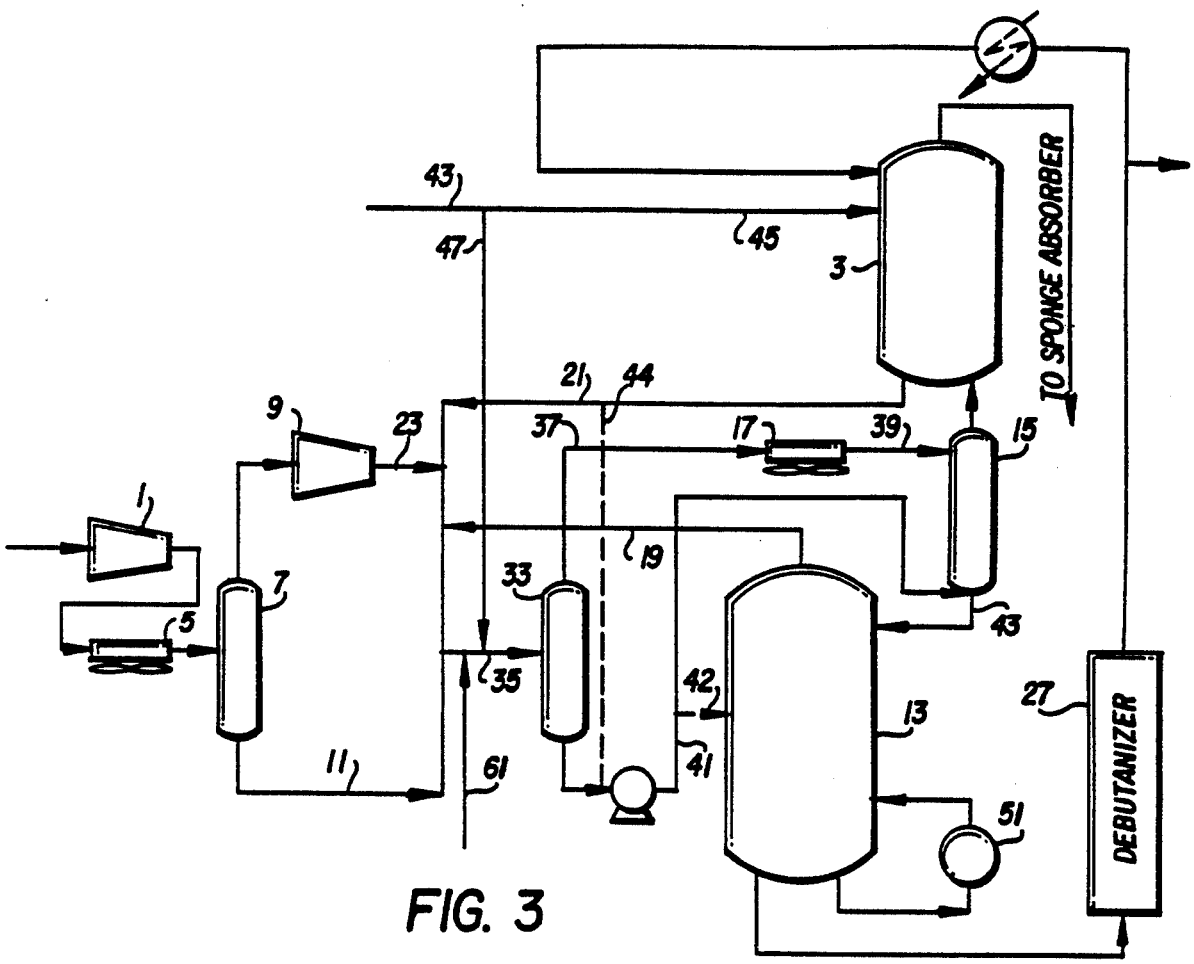
FIG. 3 illustrates additional features of an unsaturated gas plant according to the present invention.

The unsaturated gas plant system according to the present invention provides increased energy efficiency by recovering thermal energy, which would otherwise be wasted in the prior art system shown in FIG. 1. The system according to the present invention provides for separating the hot liquid hydrocarbons from the aftercooler feed. As shown in FIGS. 2 and 3, hot liquid hydrocarbons from high temperature separator 33 enter stripper 13 after mixing with the low temperature separator 15 liquid hydrocarbons. The stripper feed is at a higher temperature, e.g., by approximately 40° F. than in the conventional FIG. 1 system. Also, the total feed going to stripper 13 is decreased, thus decreasing the recycle in and out of stripper 13. These factors result in significant savings in stripper 13 reboiler 51 duty.

Both FIGS. 2 and 3 illustrate a high temperature separator 33 which receives a mixed stream, formed of gaseous outputs from second stage compressor 9 and stripper 13 overhead and liquid outputs from primary absorber 3 bottoms product and interstage receiver/separator 7, via input line 35. This corresponds to line 25 in the conventional FIG. 1 system, which carries this mixed stream directly to aftercooler condenser 17. However, by providing mixed-phase line 35 to high temperature separator 33, significant energy savings can be achieved by pumping hot liquid hydrocarbons from high temperature separator 33 along line 41 to stripper 13. As a result, the stripper feed temperature and molecular weight are increased. This makes it possible to have less reboiler duty in the stripper 13 reboiler system. Further, high temperature separator 33 provides an overhead line 37 which contains relatively less heavy ends. As a result, the bottoms product from low temperature separator 15 contains relatively less light ends. Moreover, the bottoms product flow from low temperature separator 15 is much less, in terms of volume, than the bottoms flow along line 41 from high temperature separator 33. Thus, recycling of light ends between stripper 13 and low temperature separator 15 is decreased in comparison with the prior art system shown in FIG. 1. Further, in the FIGS. 2 and 3 systems, aftercooler 17 will have a smaller duty.

The embodiment of FIG. 3 generally provides further improvements with respect to the FIG. 2 embodiment. FIG. 3 differs from FIG. 2 in that a portion of the unstabilized gasoline input along line 43 is diverted along line 47 and then combined with the mixed stream in high temperature separator input line 35. Line 47 can alternatively be connected directly to any of the lines 11, 19, 21 or 23, whose contents are mixed prior to being fed into high temperature separator 33. This bypassing of unstabilized gasoline via line 47 decreases the primary absorber liquid load and the total recycle of light components in and out of the primary absorber. Because part of the unstabilized gasoline is bypassed to high temperature separator 33 in this manner, and because the debutanized gasoline is slightly increased to maintain the same liquid petroleum gas recovery, the liquid load of absorber 3 is decreased in addition to decreasing the recycle between absorber 3 and low temperature separator 15.

It should be noted that liquid from high temperature separator 33 can be fed via line 42 directly into stripper 13 at a tray, somewhat below the tray into which low temperature separator 15 liquid is fed, or alternatively, can be fed to merge with the low temperature separator 15 liquid prior to being introduced into stripper 13. Also, line 44 can be used to bypass part of the relatively cool liquid from line 21 to line 41 to provide a temperature control of the hot liquid which is fed to stripper 13 from high temperature separator 33.

It should be noted that implementation of the embodiments of FIGS. 2 and 3, including high temperature separator 33, does not result in an increase in the wash water entering the unsaturated gas plant system when compared with the conventional system shown in FIG. 1, which uses only a low temperature separator 15. Further, the configuration of the water wash system can remain the same, except that the wash water will enter high temperature separator 33 before entering compressor aftercooler 17. A pump may be necessary to pump the wash water from high temperature separator 33 to aftercooler 17. It should further be noted that the present invention is applicable to both a FIG. 1-type unsaturated gas plant and an unsaturated gas plant with a one-tower de-ethanizer-absorber system. However, it is believed that the efficiency benefits will not be as great in a single-tower type system, as in a FIG. 1-type unsaturated gas plant. This is because in one-tower de-ethanizer-absorber systems, the stripper overhead and absorber bottoms are not cooled with the compressor discharge and interstage liquid, as is done in a FIG. 1-type unsaturated gas plant. Therefore, the internal recycle and energy requirements in single-tower de-ethanizer-absorber systems is less than in FIG. 1-type unsaturated gas plants. However, when the embodiments of FIGS. 2 and 3 are applied to a FIG. 1-type unsaturated gas plant, higher operational stability is provided particularly because buildup of water recycled throughout the system is prevented.

Tables 1–3 below include results from a simulated study of the FIG. 1 conventional system as compared with the FIGS. 2 and 3 embodiments of the present invention. The simulated study was based on a gasoline mode FCC debottleneck at 55,000 barrels per stream day (BPSD) assuming 100% Beryl vacuum gas oil feed. The simulations were performed at a variable lean oil rate to maintain a constant propane recovery of 92%, excluding the sponge absorber recovery. The $C_2$ content of the liquid petroleum gas product was set constant at 0.083 volume %. The sponge absorber, the debutanizer and their downstream equipment were not included in the computer simulation model.

TABLE 1

| Case | Description of Different Cases Presented<br>Description |
|---|---|
| A | Conventional USGP System of FIG. 1 |
| B | FIG. 2 Embodiment |
| C | FIG. 3 Embodiment |
| D | FIG. 3 Embodiment, with addition of an exchanger to preheat the stripper feed to approximately 180° F. |
| E | Conventional FIG. 1 System, with addition of an exchanger to preheat the stripper feed to approximately 180° F. |
| F | Conventional FIG. 1 System, but recontacting the absorber bottoms only |
| G | Conventional FIG. 1 System, with interstage amine absorber |
| H | FIG. 2 Embodiment, with interstage amine absorber |
| I | FIG. 3 Embodiment, with interstage amine absorber |

TABLE 2

| Case | Comparisons Without Interstage Amine Absorber<br>A | B | C | D | E | F |
|---|---|---|---|---|---|---|
| Stripper Reboiler Savings, MMBTU/Hr | 0* | 11 | 12 | 20 | 21 | 3 |
| After-Cooler Duty, MMBTU/Hr | 18 | 4 | 4 | 6 | 35 | 15 |
| Stripper Feed Preheat, MMBTU/Hr | 0 | 0 | 0 | 13 | 40 | 0 |
| Total $H_2S$ Recycle, Moles/Hr | 450 | 418 | 266 | 314 | 732 | 388 |
| $H_2S$ in LPG, Moles/Hr | 63 | 52 | 42 | 32 | 41 | 58 |
| Absorber Tray Loadings, GPM/In | 10.8 | 11.7 | 8.6 | 9.3 | 11.8 | 10.8 |
| Stripper Tray Loadings, GPM/In | 14.8 | 13.9 | 13.9 | 13.4 | 13.0 | 14.2 |

*Stripper Reboiler Duty = 57.3 MMBTU/Hr

TABLE 3

| Case | Comparisons With Interstage Amine Absorber<br>G | H | I |
|---|---|---|---|
| Stripper Reboiler Savings, MMBTU/Hr | 0* | 11 | 11 |
| After-Cooler Duty, MMBTU/Hr | 17 | 4 | 3 |
| Stripper Feed Preheat, MMBTU/Hr | 0 | 0 | 0 |
| Total $H_2S$ Recycle, Moles/Hr | 29 | 28 | 23 |
| $H_2S$ in LPG, Moles/Hr | 4.4 | 3.7 | 4.1 |
| Absorber Tray Loadings, GPM/In | 10.5 | 11.2 | 8.0 |
| Stripper Tray Loadings, GPM/In | 14.7 | 13.6 | 13.5 |

*Stripper Reboiler Duty = 55.4 MMBTU/Hr

Table 1 describes the various cases that are shown in Tables 2 and 3. The computer simulation results for Cases A-F and G-I are shown in Tables 2 and 3, respectively.

As shown in Table 2, Case C is an improvement over Case B, which itself is an improvement over Case A. The most important advantage of Case B over Case A is an 11 MMBTU/hr savings in stripper reboiler duty. The main advantages of Case C over Case B are in the $H_2S$ content of the liquid petroleum gas product and in the unloading of the primary absorber. Additionally, the fraction of the unstabilized gasoline diverted to high temperaure separator 33 provides an excellent means to control the corrosive components recycled throughout the system. $H_2S$ recycle can be reduced by 61%, compared to Case A, if all the unstabilized gasoline is fed to high temperature separator 33. However, this will require the lean oil circulation to increase tremendously, resulting in an increase in the stripper liquid loading by 13%, in turn resulting in no savings on stripper reboiler duty compared to Case A. Case C represents a 33% split fraction (not optimized). This fraction can be optimized on a case-by-case basis.

As noted above, an important advantage of the present invention is a significant increase in operation stability. This makes further energy conservation feasible. This can be seen by comparing Case D with Case E. Both Case D and Case E correspond to preheating the stripper feed to approximately 180° F. by an external source in Cases C and A, respectively. It should be noted that approximately 40 MMBTU/hr of external heat duty is required to preheat the stripper feed to 180° F. in Case E. The corresponding duty requirement for Case D is only 13 MMBTU/hr. This difference causes the aftercooler duty requirement for Case E to be six times that in Case D. The $H_2S$ recycle and $H_2S$ content of liquid petroleum gas in Case E are 2.33 and 1.28 times that in Case D. These differences increase as the feed preheat temperature increases.

One effective method for reducing $H_2S$ recycle in conventional unsaturated gas plants, such as that shown in FIG. 1, is to recontact only the absorber bottoms and not the overhead stripper. This is represented in Case F. In other words, in such case, stripper overhead is not combined with lines 11, 21 and 23 of FIG. 1. Comparison of Case C and Case F reveals that Case C not only reduces the $H_2S$ recycle much more effectively than Case F, but is more efficient in all aspects of unsaturated gas plant operation than is Case F.

One result of the FIGS. 2 and 3 embodiments is the increase in solubility of water in the stripper feed line 43. However, almost all of the additional water will leave the stripper and the stripper overhead vapor which will be condensed out in high temperature separator 33 and low temperature separator 15. Therefore, this should not be a disadvantage in the gas plant operation.

Finally, Table 3 shows the computer simulation results for Cases A, B and C for an unsaturated gas plant with an interstage amine absorber. Comparisons of these cases reveal that all of the above conclusions made are applicable to an unsaturated gas plant with or without an interstage amine absorber. However, there will not be as much need for installation of an expensive interstage amine absorber if the FIGS. 2 and 3 low $H_2S$ recycle systems are implemented.

Additionally, as shown in FIG. 3, hot unstabilized gasoline can be fed directly into input line 35 of high temperature separator 33 from a main column fractionator by pumping an unstabilized heavy gasoline stream along line 61 from this main column. Line 61 can alternatively be connected directly to any of the lines 11, 19, 21, 23 or 47. Feeding hot unstabilized gasoline from a main column will provide energy savings which would otherwise be wasted in the main column overhead condenser. However, the wet gas compressor power requirement will slightly increase. Further, unstabilized gasoline can be diverted and recontacted with the first stage compressor discharge in a high temperature flash. The vapor will be cooled in the compressor aftercooler and then flashed in a low temperature separator. The liquids from the low temperature separator and the high temperature separator are then pumped to the high temperature separator of the unsaturated gas plant at a higher temperature than otherwise. This may provide additional energy savings.

The above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

I claim:

1. An unsaturated gas plant, comprising:

first means for receiving a low pressure gas and separating said low pressure gas into a liquid output and a gaseous output;

an absorber for receiving unstabilized gasoline and a lean hydrocarbon oil, and producing a gaseous overhead product and an absorber bottoms product therefrom;

a stripper for receiving and separating a liquid hydrocarbon input into a gaseous overhead product and a liquid bottoms product;

first conduit means interconnecting the first means, the absorber and the stripper for supplying an admixture comprising the liquid and gaseous outputs from said first means, said absorber bottoms product and the gaseous overhead product from said stripper to a high temperature separator for separating said admixture into a liquid hydrocarbon output and a gaseous output, said high temperature separator being connected to said stripper for conveying said liquid hydrocarbon output thereto and further connected to a condenser in series with a low temperature separator for conveying said gaseous output from said high temperature separator thereto for separating a condensed gaseous output from said condenser into a gaseous overhead product output and a liquid bottoms product, said low temperature separator being connected to said absorber for conveying said gaseous overhead product output thereto and further connected to said stripper for conveying said liquid bottoms product output thereto.

2. The unsaturated gas plant of claim 1, further comprising second conduit means for supplying said unstabilized gasoline to said absorber, said second conduit means being connected to said first conduit means for diverting a portion of the unstabilized gasoline supply away from said absorber to mix said portion with said admixture in said first conduit means prior to being supplied to said high temperature separator.

3. The unsaturated gas plant of claim 1, wherein said first means comprises in series, a first stage compressor for receiving said low pressure gas, an interstage cooler, and an interstage receiver/separator, said interstage receiver/separator separating a cooled low pressure gas from the interstage cooler into said liquid output from the first means and a gaseous output portion, a second stage compressor receiving said gaseous output portion from said interstage receiver/separator and producing said gaseous output from said first means.

4. The unsaturated gas plant of claim 3, further comprising second conduit means for supplying said unstabilized gasoline to the absorber, said second conduit means being connected to said first conduit means for diverting a portion of said unstabilized gasoline away from said absorber to mix said portion with said admixture in the first conduit means prior to being supplied to said high temperature separator.

* * * * *